United States Patent [19]

Nishiyama et al.

[11] Patent Number: 4,838,063

[45] Date of Patent: Jun. 13, 1989

[54] METHOD FOR MANUFACTURING METALLIC TUBE MEMBERS

[75] Inventors: Sinichi Nishiyama; Hajime Abe; Kuniaki Seki; Noboru Hagiwara, all of Ibaragi, Japan

[73] Assignee: Hitachi Cable, Ltd., Tokyo, Japan

[21] Appl. No.: 148,323

[22] Filed: Jan. 25, 1988

Related U.S. Application Data

[63] Continuation-in-part of Ser. No. 761,919, Aug. 2, 1985.

[30] Foreign Application Priority Data

Oct. 9, 1984 [JP] Japan ..... 59-189215
Oct. 9, 1984 [JP] Japan ..... 59-189217

[51] Int. Cl.[4] ..... B21B 45/00
[52] U.S. Cl. ..... 72/47; 29/527.2
[58] Field of Search ..... 29/527.2; 72/46, 47, 72/283, 286; 427/190, 191, 239

[56] References Cited

U.S. PATENT DOCUMENTS

| | | | |
|---|---|---|---|
| 3,169,635 | 2/1965 | Prindle | 72/283 X |
| 3,293,894 | 12/1966 | Edgecomb et al. | 72/46 X |
| 3,353,387 | 11/1967 | Johnson | 72/46 |
| 3,476,080 | 11/1969 | Clarke | 72/46 X |
| 3,744,290 | 7/1973 | Sirois | 72/283 |
| 4,745,787 | 5/1988 | Sansome et al. | 72/283 X |

*Primary Examiner*—Timothy V. Eley
*Attorney, Agent, or Firm*—Helfgott & Karas

[57] ABSTRACT

A method for coating the inner surface of a metal tube with a metal layer consisting of one or more metals, the metal layer having a melting point lower than that of the metal tube, the method comprising;

thinly applying a mixture consisting of a low melting point powder and a flux composition to the inner surface of the tube by the use of a plug, and heating the tube to which the mixture has been applied at a temperature being at least the melting point of the low melting point powder but lower than the melting point of the metal tube to fuse the powder.

11 Claims, 3 Drawing Sheets

METHOD FOR MANUFACTURING METALLIC TUBE MEMBERS

CROSS REFERENCE TO COPENDING APPLICATIONS

This application is a continuation-in-part of copending application Ser. No. 761,919 filed 08/02/85

TECHNICAL FIELD

This invention relates to metallic tube members and the method for manufacturing the same. More particularly, the invention relates to various metallic tube members, the inner surfaces of which are covered with a different metal from that of the tube material and the method for manufacturing the same.

BACKGROUND OF THE INVENTION

It is know that amongst metals used to manufacture metal tubes, copper and copper alloys have comparatively good corrosion resistance. Suitable copper allows having excellent corrosion resistance include Cu-Sn, Cu-Ni, Cu-Al, Cu-Zn-A, Cu-Sn-Pb, and Cu-Ag. However, most of these copper allows contain large amounts of added metals. In the manufacture of tubes, working conditions for melting, casting, and plasticity become inevitably severe as compared with the case where pure copper or other copper alloy tubes containing a minor amount of other added metals are manufactured so that such alloy tubes become very expensive.

On the other hand, when pure copper or copper alloy of a lower content containing an additive such as Sn, Ni, Al, Zn, Pb, Ag or the like is used for manufacturing tube members, the tubes may be produced at a much lower cost.

A copper alloy having excellent corrosion resistance exhibits its corrosion-resistant function at only the surface portion which is in contact with liquid, gas or the like, and the remainder shares only the mechanical strength of the shaped copper alloy tube.

Accordingly, a composite tube constructed of pure copper or a copper alloy of a low additive content and wherein only the inner surface thereof is a copper alloy having excellent corrosion-resistance, functions as well as a metallic tube made entirely of corrosion-resistant materials.

Furthermore, the following methods for manufacturing composite tubes by covering the inner surface of a tube with different metal from that of the tube itself have heretofore been know:

(1) Extrusion

A composite (double) tube is obtained by employing a composite extruded billet which has previously been prepared by combining an inner layer with an outer layer, and covering the inner surface of the tube with a different metal using extrusion molding. However, this method is expensive since it involves many manufacturing steps such as preparation, extruding and further drawing of composite billets to reduce the diameter thereof to a prescribed dimension. Furthermore there is also the possibility, that where the metal covering the inner surface is a metal of low melting point, it can melt due to heat at deformation in case of extrusion molding, so that suitable composite tubes cannot be obtained. In addition to the above disadvantages, there may also be difficulties in normal extrusion, drawing and the like where there is a sufficient difference in distortion resistance between a tube body member and covering member.

(2) Inner surface plating

In this method, the covering is made by passing a plating solution of a coating metal through the inner surface of a tube for electroplating thereon. Such method is, however, unsuitable for industrial production because the controls for concentration of plating solution, current density and the like become complicated for treating a tube member in continuous lengths.

(3) Welding tube

In this method a tube member is clad with a covering material and the tube material and the covering material are subjected to seam welding to form a tubular shape. However such tube material and covering material are molten and admix with each other at the welding point so that it is difficult to effect normal welding. Moreover there are further disadvantages in than either the covering metal appears at the outer surface of the tube, or the tube body material appears at the inner surface of the tube at the seam-welded portion thereby preventing a uniform covering layer over the inner surface of the tube.

SUMMARY OF THE INVENTION

Accordingly, it is thee first object of the present invention to provide a very inexpensive metal tube and a method for manufacturing the same.

The second object of the present invention is to provide a metal tube having excellent corrosion resistance and a method for manufacturing the same.

The third object of the present invention is to provide a metal tube in continuous lengths and a method for manufacturing the same.

The fourth object of the present invention is to provide a metal tube internally coated uniformly with a coating layer and a method for manufacturing the same.

The fifth object of the present invention is to provide a metal tube suitable for industrial production and method for manufacturing the same.

In order to realize the above objects, the metal tubes according to the present invention have an inner surface coated with a thin metal or alloy layer having a lower melting point than that of the tube material. The coating is formed by applying a mixture consisting of the coating metal or alloy in powder form and a liquid or paste flux to the inner surface and then heat treating the tube and the mixture.

Furthermore, the method for manufacturing a metal tube according to the present invention comprises the steps of:

(a) thinly applying a mixture consisting of a low-melting point metal powder and a liquid or paste flux to the surface of the tube by the use of a plug or mandrel, (b) heating the tube member to which the mixture has been applied at a temperature being at least the melting point of the powder but lower than the melting point of the tube to fuse the powder, and (c) drawing the heat and/or diffusion-treated tube by the use of the plug or mandrel.

BRIEF DESCRIPTION OF THE DRAWINGS

For the purpose of illustrating the invention, there are shown in the drawings forms which are presently preferred, it being understood, however, that this invention is not limited thereto.

DETAILED DESCRIPTION OF A PREFERRED EMBODIMENT

Figure 1:
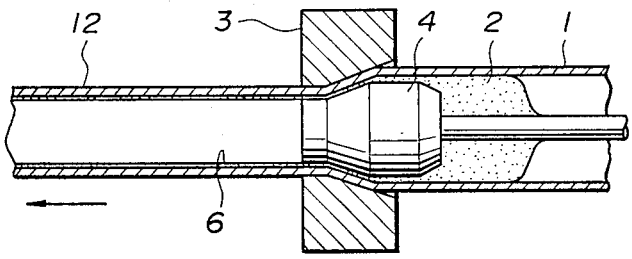
FIGS. 1–3 are cross-sectional views, each illustrating an embodiment for applying a coating mixture to the inner surface of a tube in the method for manufacturing the tube.

The present contemplates providing inexpensive and excellent corrosion-resistant metal tubes and a method for manufacturing such tubes.

Accordingly to the present invention, a mixture of a powder of a metal or metal alloy having a lower melting point than that of tube and a liquid or paste flux is applied to the inner surface of the tube, and the treated tube is heat treated.

In accordance with such method, the inner surface of a tube of continuous length can easily be coated by utilizing a plug or a mandrel, the powder in the mixture applied being fused by heat treatment and hereby flowing with the aid for the flux to cover the inner surface of the tube. In this case, a diffusion layer produces a covering layer of the low-melting metal on the inner surface of the tube, and when subsequent heat treatment is applied, diffusion is completed so that the inner surface of the tube is easily alloyed. With respect to metal tubes made of copper, copper alloy, aluminum, aluminum alloy, steel, stainless steel, titanium, titanium alloy, magnesium, magnesium alloy, nickel, or nickel alloy, suitable metals which may be used in the coating powder include Sn, Pb, Zn, Al, Ag, Ni, Au, Bi, Te, Cd, Ga, In and the like. Furthermore, a mixture containing two or more of these metals, where the total content of one is 50% or more, exhibits practical advantages of covering the entire inner surface, even if a minor amount of a metal other than the foregoing is added.

The liquid or paste materials which may be mixed with the metal powder will be a flux which serves as an adhesive material, removes surface oxide, and is capable of promotion wetability between the surface of the tube member and the molten metal when the metal powder applied to inside the metal tube is fused.

The heating temperature required will be at least that temperature of which the powder fuses and begins to flow. While the upper limit of the heating temperature may theoretically be lower than the melting point of a tube member, it is desirable that the heating temperature be lower than the melting point of the tube material by about 50° C. The heat treatment can be carried out in an atmosphere of air, nitrogen, carbon dioxide, hydrogen or argon gas. Where the atmosphere is other than air, an atmosphere continuous a mixture with 50% or more of one of the aforesaid gas components is effective.

When heat treatment is carried out under the hereinbefore described conditions, a metal coating derived from the aforesaid powder is formed and at the same time a diffusion layer is partly produced on the inner surface of the tube member. It is effective to employ a subsequent heat-treating process for accelerating the diffusion as well as alloying the surface layer of the tube member.

It is preferred that the amount of powder in the flux-powder mixture be within a weight ration of 5–98%. When the mount of the flux is increase, the covering of low-melting metal becomes discontinuous. When the amount of the flux is decreased, uniform application of the covering on the inner surface of the tube becomes difficult. In such case, the flux function itself is insufficient so that the metal covering adheres only partly to the inner surface of the tube member.

The use of a metal powder having smaller diameter particles facilitates mixing with the flux and provides a stable suspension. When the particle diameter is 20 mesh (0.84 mm) or more, it becomes difficult to uniformly admix such powder with the flux to enable the powder to adhere to the inner surface of the tube and provide a uniform coating thereon, even after melting the powder. Although very finely divided powder may be employed, it is difficult and costly to produce and also handling it can result in combustion in air. For such reasons, it is preferable that the particle diameter of such powder be 0.001 mm or more.

A tube having an inner surface provided with grooves or projections may be used in the method of the present invention. In such case the grooves or projections on the inner surface of the tube serve to effectively increase the degree to which the powder adheres to the inner surface of the tube thereby improving wetability of the covering metal with respect to the inner surface of a tube, and reducing th unevenness of such covering metal. In this respect the configuration, number and distribution of the grooves or projections are not restricted. In addition, a tube having an inner surface roughened by filing without forming grooves or projections may also be utilized. The dimensions of an individual groove should preferably be larger than the average particle diameter of the metal powder. Accordingly, it is preferred the grooves have a depth of 0.01 mm or more and a width of 0.05 mm or more. When the dimensions of the grooves are larger, the amounts of flux and metal powder to be used must be increased, if not, a non-uniform inner surface coating is obtained and wetability is not improved. More preferably, the grooves will have a depth of 3 mm or less and a width of 10 mm or less.

Where the configuration of the inner surface projections are discontinuous and have an island shape, or the projection configuration is non-uniform, preferably the depth will be 0.01–3 mm. Furthermore, it is preferable that the area occupied by the projections is 5–90% of the total area where the projections cover the entire inner surface of the tube. Such grooves or projections may be performed on the inner surface of the tube or may be defined on the inner surface immediately before applying the metal powder-flux mixture.

Various embodiments of the present invention will be described hereinbelow in conjunction with the accompanying drawings.

FIG. 1 illustrates one embodiment wherein mixture 2 consisting of a metal powder and flux is continuously applied to the inner surface of metal tube 1 to form a thin film 6 and metal tube 1 is drawn through a die 3. Plug 4 is inserted into the interior of the metal tube 1 at the position engaged with die 3 and mixture 2 to be applied is stored behind the drawing zone.

A quantity of mixture 2 in the metal tube is applied to the inner walls as the tube moves forward between plug 4 and die 3 but the majority of the mixture remains behind the drawing zone. Although lubrication between the metal tube 1 and plug 4 is provided by the mixture 2 so that no additional lubrication is necessary, it is preferred to apply some additional lubrication between tube 1 and die 3.

The thickness of thin layer 6 of mixture 2 can be adjusted by selecting a suitable outer diameter for plug 4.

Figure 2:
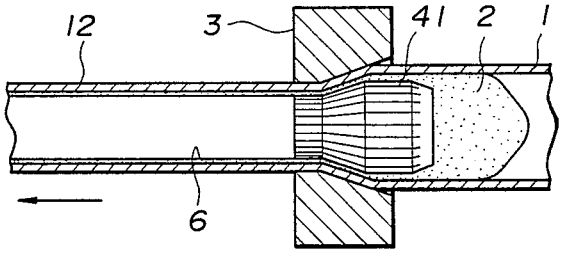

FIG. 2 illustrates another embodiment for adjusting the thickness of thin layer 6 of mixture 2 wherein plug 41 having a number of shallow grooves parallel to the axis of the tube on its surface is utilized so that a prescribed amount of mixture 2 can be applied to the inner surface of tube 1 since the mixture flows into the grooves at the time of drawing.

Figure 3:
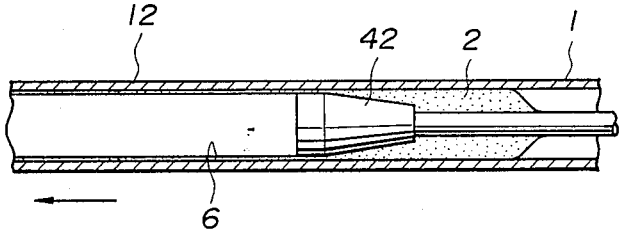

FIG. 3 illustrates another embodiment showing an alternative method of applying mixture 2 wherein plug 42 has a diameter slightly smaller than the inner diameter of tube 1. The extreme portion of plug 42 is tapered so that tube 1 may be moved over the plug to apply a thin layer of mixture 2 without deforming tube 1.

Figure 4:
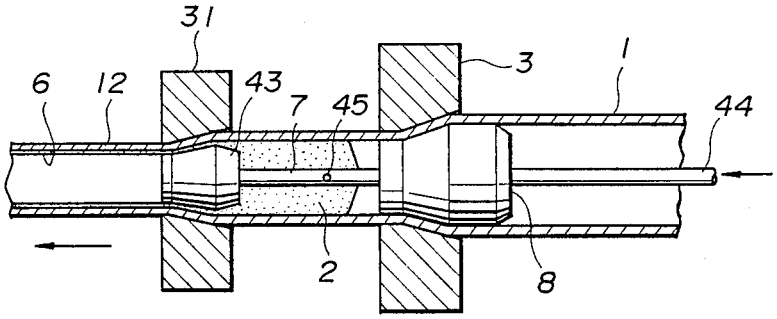
FIGS. 4–7 are longitudinal cross-sectional views each illustrating another embodiment for applying the coating mixture to the inner surface of a tube.
Figure 5:
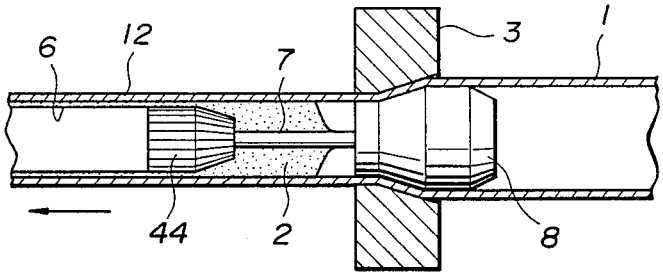

FIGS. 4 and 5 illustrate other embodiments wherein each of plugs 43 and 44 used to apply mixture 2 is supported by floating plug 8 through supporting rod 7. FIG. 4 illustrates an embodiment wherein a metal tube member is once squeezed by means of a first die 3 and a second die 3, whereby the mixture 2 contained inside tube 1 between dies 31 and 31 is uniformly applied to the inner surface of tube 1 by means of application plug 43. Furthermore, a powder is delivered from cylinder 44 passing rewardly through floating plug 8 and is issued from midpoint 45 of supporting rod 7.

FIG. 5 illustrates another embodiment wherein plug 44 is provided with shallow grooves as shown in FIG. 2 and is utilized as the means for applying mixture 2. In both FIGS. 4 and 5, since floating plug 8 is employed to support application plug 43 or 44, it is not necessary to support the application plug outside the tube to process continuous lengths.

Where the tube inner surface is provided with a plurality of linearly or spirally extending grooves or projections along its axial direction, the grooves or projections are not necessarily required to be continuous, but they maybe independent, divided into sections by cross grooves and the like. When the inner surface of a tube is provided with grooves or projections, wetability, unevenness and the like of a coating metal are improved with respect to the inner surface of such tube.

Figure 6:
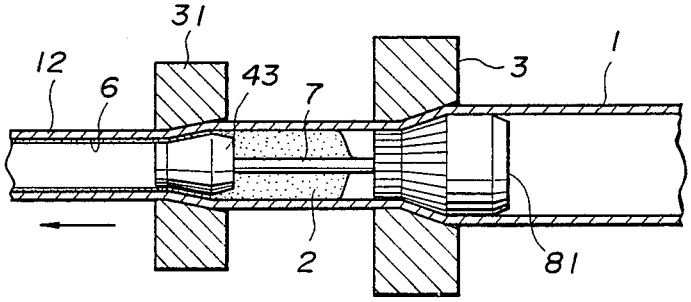
Figure 7:
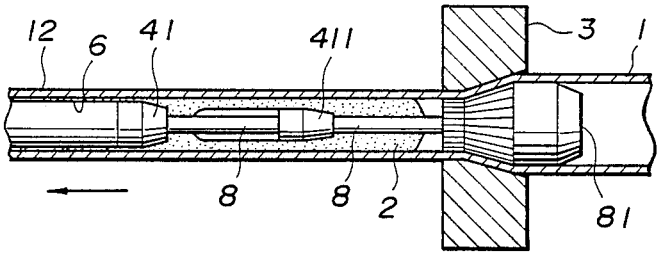
Figure 8:
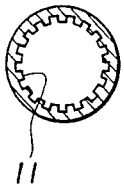
FIGS. 8(*a*)–(*f*) are cross-sectional views each showing an example of cross-section of a tube to which a coating mixture has not yet been applied.
Figure 8:
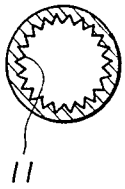
Figure 8:
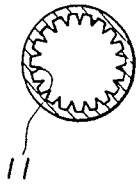
Figure 8:
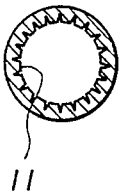
Figure 8:
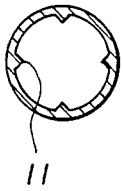
Figure 8:
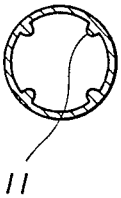

FIGS. 6 and 7 show embodiments wherein the inner surface of such tube as described above is defined or provided with grooves or projections immediately before applying mixture 2 to the inner surface of the tube. Floating plug 81 having a number of grooves or projections on its outer surface engages a squeezing portion of die 3 whereby mixture 2 is positively applied to the inner surface of the tube due to the concave and convex notching formed as the tube is drawn through die 3. Furthermore, in accordance with the embodiment of FIG. 7, plug 411 having a diameter smaller than the tube is interposed between plug 41 and floating plug 81. A layer of mixture 2 is made comparatively thick by means of plug 411 and then such layer is adjusted to a prescribed thickness by means of plug 41 disposed forward of plug 411. FIGS. 8(*a*)–(*f*) illustrate cross section configurations of such grooves or projections 11 formed on the inner surface of each tube drawn by means of plug 81 having grooves on its outer surface.

Tube 12, the inner surface of which has received a thin layer 6 of mixture 2, is heated treated at a temperature being at the melting point or above of the metal powder contained in the thin layer 6, the temperature being below the melting point of tube 1 itself. As a result, surface oxide on the inner surface of the tube is removed by means of a flux contained in thin layer 6, whereby wetability between the tube and the molten coating metal is improved and a thin layer of the coating metal, including a diffusion layer is formed on the inner surface.

When tube 1 having grooves or projections on the inner surface is used, a part of the coating metal remains on the inner surface of the tube. When a smooth walled inner surface is desired, it is preferable to effect the drawing operation by utilizing either a die and plug or only a plug.

In order to promote diffusion of a thin covering layer of a coating metal formed on *the inner surface of a tube by heat treatment, an additional heat treatment is preferable and such additional heat treatment may be effected before or after an additional drawing process.

Figure 9:
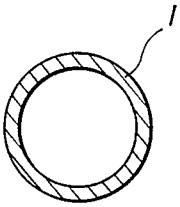
FIGS. 9(*a*)–(*d*) show cross sections of tubes drawn by means of the device shown in FIG. 7.
Figure 9:
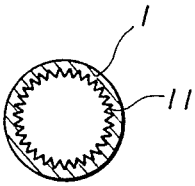
Figure 9:
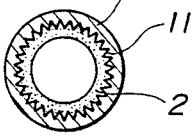
Figure 9:
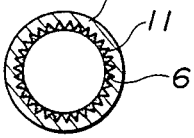

FIGS. 9(*a*)–(*d*) show cross sections of tube members drawn by means of the device illustrated in FIG. 7 in accordance with the processes as described above wherein FIG. 9(*a*) illustrates the cross section of a metal tube which has not yet been formed with die 3. FIG. 9(*b*) illustrates the cross section of a tube provided with grooves formed with the floating plug 81. FIG. 9(*c*) illustrates the cross section of a tube where the inner surface has received an application of mixture 2 using plug 411. FIG. 9(*d*) illustrates the cross section of a metal tube where the thickness of the mixture 2 on the inner surface has been adjusted to a prescribed thickness.

Specific examples of the present invention will be described hereinbelow.

EXAMPLE 1

To cover the inner surface of a copper tube having an outer diameter of 9.52 mm and a thickness of 0.41 mm with Sn. A mixture of Sn powder having an average particle diameter of 105 μm (145 mesh) or less and a liquid flux known under the trademark "SPARKLE FLUX 401" as manufactured by Senju Metal Industry Co., Ltd., Japan used for soldering copper in a ration of 7:3 was prepared. The copper tube was then heat treated at 260° C. for 10 minutes to provide a copper tube having substantially uniform thin Sn covering on the inner surface. The thickness of the covering prior to heat treatment was 0.1 mm; the thickness after heat treatment was reduced to 0.03 mm.

EXAMPLE 2

The same process as that Example 1 was effected except that the tube was heated at 500° C. for 10 minutes to provide a copper tube having an inner surface coated with a Cu-Sn alloy layer. The covering thickness is 0.41 mm, and the alloy layer thickness is 30 to 50 mm.

EXAMPLE 3

A copper tube similar to that of Example 1 was coated with a mixture of an Al-12% Si alloy powder having an average particle diameter of 53 μm (280 mesh) or less and a liquid flux known under the tradename ALPHALUX as manufactured by Senju Metal Industry Co., Ltd., Japan used for brazing Al in a ratio of 7:3. The resulting mixture was applied to the inner surface of the tube using a plug. The copper tube was then heat treated at 600° C. for 10 minutes to provide a copper tube having a thin coating layer of the Al-12% Si alloy on the inner surface. The thickness of the coating prior to heating was 0.1 mm. The thickness of the layer after treatment was 0.05 mm.

EXAMPLE 4

To coat the inner surface of a steel tube having an outer diameter of 27 mm and a thickness of 2.5 mm with Zn, a creamy mixture of Zn powder flux known under the trademark "ZINCREM" as manufactured by Senju Metal Industry Co., Ltd., Japan was prepared. The resulting mixture was uniformly applied to the inner surface of the tube by use of a plug. The steel tube was then heat treated at 450° for 5 minutes to provide a steel tube having substantially uniform Zn layer on the inner surface. The thickness of the coating prior to heating was 0.3 mm. The thickness of the layer after treatment was 0.05 mm.

EXAMPLE 5

To cover the inner surface of a brass tube having an outer diameter of 22 mm and a thickness of 1 mm with a Pb-Sn alloy, a mixture of a liquid flux commercially identified as SPARKLE FLUX 402 and a powder of Pb-Sn solder was prepared in a ratio of 3:7. The brass tube was drawn and at the same time the metal mixture was applied to the inner surface of the tube. The internally coated brass tube was then heat treated at 260° C. for 10 minutes to provide a brass tube having a thin Pb-Sn Alloy layer on the inner surface. The thickness of the coating prior to heating was 0.1 mm. The thickness after heating was 0.03 mm.

EXAMPLE 6

A steel tube provided with projections on the inner surface thereof having an outer diameter of 27 mm, a bottom thickness of 2 mm, a projection height of 0.1 mm, a projection width of 0.5 mm, and a projection number of 24 lines was drawn to a 25 mm outer diameter and coated employing the same mixture as that of Example 3. The steel tube was then heat treated at 600° C. for 10 minutes to provide a steel tube having a thin Al-12% Si-alloy layer on the inner surface. The thickness of the coating on each projections and groove prior to heating was 0.1 mm and 0.2 mm respectively. The respective layer thicknesses after heating were 0.03 and 0.1 mm.

EXAMPLE 7

A copper tube similar to that of Example 1 and having a number of projections on the inner surface with a height of 0.15 mm was drawn to 8.8 mm outer diameter and internally coated with the same mixture as used in Example 1 except that the mixing ratio was 8:2. The copper tube was then heat treated at 260° C. for 10 minutes. The resulting tube was then drawn further using a die of 7.5 mm inner diameter and a plug of 6.6 mm outer diameter. The resulting copper tube had a flat inner surface of a thin Sn layer formed thereon. The projection and groove coating thickness prior to heating were 0.05 mm and 0.2 mm respectively. The corresponding thickness after heating were 0.04 mm and 0.16 mm respectively.

EXAMPLE 8

To thinly coat the inner surface of a copper tube having an outer diameter of 9.52 mm, a bottom thickness of 0.41 mm, and a projection height of 0.15 mm with Bi, a paste mixture of a liquid flux SPARKLE FLUX 402 and Bi powder in a ration of 3:7 was prepared. The outer diameter of the copper tube was reduced to 8.8 mm by means of a die and a plug using the paste mixture as a lubricant thereby forming a thin layer of the mixture on the inner surface of the tube. The resulting copper tube was then heat treated at 300° C. for 10 minutes to provide a copper tubing having a thin Bi covering layer on the inner surface. The projection and groove coating thicknesses prior to heating were 0.05 and 0.2 respectively. After heating the corresponding layer thickness were 0.02 mm and 0.15 mm respectively.

EXAMPLE 9

To coat the inner surface of an aluminum tube having an outer diameter of 15.88 mm, a bottom thickness of 0.6 mm, and 0.1 mm high inner surface projections with Zn, a mixture of a liquid flux, ALPHA LUX, and Zn powder in a ratio of 2:8 was prepared. The mixture was applied to the inner surface of the tube using a plug. The aluminum tube was heat treated at 450° C. for 10 minutes and then at 350° for 2 hours. The resulting aluminum tube was drawn using a die having an inner diameter of 12.7 mm and a plug an outer diameter of 10.9 mm. The treated aluminum tube had a flat inner surface of a thin Al-Zn alloy layer. The projection and groove coating thickness prior to heating were 0.1 mm and 0.2 mm respectively. After heating, these thickness were 0.05 mm and 0.15 mm respectively.

EXAMPLE 10

To coat the inner surface of a copper tube having an outer diameter of 12.7 mm and a thickness of 0.64 mm with Sn, a space defined between two plugs shown in FIG. 6 was charged with the same mixture as that of Example 1. The mixture was squeezed by utilizing a plug having an outer diameter of 8.3 mm and 20 grooves, each with a depth of 0.15 mm on the surface while reducing the copper tube to a 9.52 mm outer diameter and a 8.5 inner diameter by means of a die and a plug. As a result, a layer of mixture having a comparative thickness was formed. The resulting copper tube was heated-treated as in Example 1 to provide a copper tube having a thin Sn layer on the inner surface.

EXAMPLE 11

A copper tube such as was used in Example 10, except that 60 grooves, each having a depth of 0.15 mm were defined on the inner surface thereof, was processed by use of a smooth surfaced application plug under the same conditions as in Example 10. The resulting copper tube has a substantially uniform thin Sn layer on the inner surface.

EXAMPLE 12

The inner surface of a copper tube such as used in Example 10 was grooved and covered with the same mixture used in Example 10 using a plug having 20 grooves on the surface, each having a depth of 0.15 mm and a smooth surfaced application plug. The resulting copper tube had a substantially uniform thin Sn layer on the inner surface.

EXAMPLE 13

The diameter of a copper tube such as used in Example 10 was reduced by means of a first plug as shown in FIG. 5 using the same mixture as in Example 10. The mixture was then further applied to the copper tube while reducing the outer diameter to 9.2 mm employing a second plug and a die. The resulting copper tube was then heat-treated under the same conditions as in Example 10 to provide a copper tube having a thin layer on *the inner surface.

EXAMPLE 14

Example 12 was repeated except that a plug provided with 30 grooves, each having a depth of 0.15 mm was used as the forward application plug to provide a copper tube having a thin Sn layer on the inner surface.

EXAMPLE 15

To coat the inner surface of a series of cooper tubes having an outer diameter of 45 mm and a bottom thickness of 5 mm with Sn and having continuous projections (grooves) on the inner surface of 0.008 mm in height and 0.01 mm in width, 0.01 mm in height and 0.05 mm in width, 0.05 mm in height and 0.1 mm in width, 1 mm in height and 5 mm in width, 3 mm in height and 10 mm in width, or 5 mm in height and 20 mm in width respectively, each of the copper tubes was drawn to 41 mm outer diameter by means of a die and plug using the mixture of Example 1 as a lubricant. The tubes were then heat treated at 260° C. for 10 minutes. The resulting copper tube having an inner surface provided with projections of 5 mm in height and 20 mm in width on the inner surface exhibited a partial Sn swelling, although Sn extended over the entire inner surface of the tube. The remaining copper tubes all exhibited an inner surface on which a thin Sn layer was formed.

EXAMPLE 16

The inner surface of a series of copper tubes having an outer diameter of 15.88 mm and a bottom thickness of 0.9 mm was provided with hemispherical projections, each having a height of 0.3 mm with varying densities, i.e., 4, 10, 20, 100 and 250 projections per $cm^2$ on the inner surface of the tube were prepared. the volume of these projections corresponded to 1.5%, 3.8%, 7.6%, 15%, 38% and 95% of an inner surface of a tube totally occupied by the projections.

The diameter of each copper tube was reduced to 12.7 mm using the same mixture, die and plug as in Example 3. The reduced copper tube was heat treated at 600° C. for 10 minutes. The resulting tubes having inside projections of $4/cm^2$ or 10 $cm^2$ on the inner surface were partially exposed. The extreme ends of the projections were exposed in the copper tube provided with projections of $250/cm^2$ since the amount of Al-12% Si alloy was insufficient. Each of the other copper tubes exhibited an inner surface coated with a thin Al-12% Si alloy layer.

As is apparent from the above description, the present invention relates to a metal tube having an inner surface coated with a different metal or alloy layer so that the resulting tube material exhibits excellent corrosion resistance and thee like. Furthermore, the coating layer may be formed in such a manner that a mixture prepared from a powder of the metal or alloy and a liquid or paste flux is readily applied to the inner surface and fused or melted by heat treatment. Moreover, a coating for the inner surface of a tube may be easily changed by merely changing the mixture composition. The method of the present invention is particularly advantageous for coating the inner surfaces of slender tubes because there is no limitation as to the dimension of the tube.

Although several specific embodiments of the invention have been illustrated, it will be obvious to those with ordinary skill in the art that other modifications and embodiments exist which will come with the spirit and scope of the invention as set forth in the appended claims.

What is claimed is:

1. A method for coating the inner surface of a metal tube with a metal layer consisting of one or more metals, said metal layer having a melting point lower than that of the metal tube, the method comprising:

(a) thinly applying a mixture consisting of a low melting point powder and a flux composition to the inner surface of the tube by the use of a plug, and (b) heating said tube to which said mixture has been applied at a temperature being at least the melting point of said low melting point powder but lower than the melting point of the metal tube to fuse said powder.

2. A method as claimed in claim 1, wherein the mixture is applied to the inner surface of the tube by moving said tube relative to the plug without reducing the area of said tube.

3. A method as claimed in claim 1, wherein the mixture is applied to the inner surface of the tube while reducing the area of said tube.

4. A method as claimed in claim 1, wherein the mixture is applied to the inner surface of the tube, said tube having a plurality of grooves on its inner surface.

5. A method as claimed in claim 1, wherein the surface of the plug applying the mixture is provided with a pluralilty of grooves.

6. A method as claimed in claim 1, wherein the mixture is applied by use of either plug of a pair of plugs while reducing the area of the tube by use of the other plug.

7. A method as claimed in claim 6, wherein a plurality of grooves are formed on the inner surface of the tube by reducing the area of said tube.

8. A method as claimed in claim 6, wherein the surface of plug for applying the mixture is provided with a plurality of grooves.

9. A method as claimed in claim 1, wherein the fused powder is diffused.

10. A method as claimed in claim 9, wherein the heat treated tube is drawn using a plug.

11. A method as claimed in claim 1, wherein the heat treated tube is drawn using a plug.

* * * * *